US008187418B2

(12) United States Patent
Kajander et al.

(10) Patent No.: US 8,187,418 B2
(45) Date of Patent: May 29, 2012

(54) METHOD OF MAKING MULTILAYER NONWOVEN FIBROUS MATS

(75) Inventors: Richard Emil Kajander, Toledo, OH (US); Alan Michael Jaffee, Bowling Green, OH (US); Paul Russell Swartz, Perrysburg, OH (US); Richard Jon Kindle, Bowling Green, OH (US)

(73) Assignee: Johns Manville, Denver, CO (US)

( * ) Notice: Subject to any disclaimer, the term of this patent is extended or adjusted under 35 U.S.C. 154(b) by 1179 days.

(21) Appl. No.: 12/006,901

(22) Filed: Jan. 7, 2008

(65) Prior Publication Data

US 2008/0108266 A1 May 8, 2008

Related U.S. Application Data

(63) Continuation of application No. 11/179,393, filed on Jul. 12, 2005, now abandoned.

(51) Int. Cl.
*D21H 27/38* (2006.01)
*D21H 13/40* (2006.01)

(52) U.S. Cl. ..... 162/123; 162/129; 162/141; 162/145; 162/146; 162/156; 162/158; 156/60

(58) Field of Classification Search ..... 162/123–133, 162/141, 145–146, 152, 156, 157.1, 158; 156/39, 60, 62.2
See application file for complete search history.

(56) References Cited

U.S. PATENT DOCUMENTS 2,694,630 A * 11/1954 Landes et al. ..... 162/156
2,757,114 A 7/1956 Roberts
2,758,026 A * 8/1956 Landes et al. ..... 162/145
2,810,646 A * 10/1957 Wooding et al. ..... 162/146
2,881,072 A * 4/1959 Clark ..... 162/104
3,054,757 A 9/1962 Turner
3,123,518 A * 3/1964 Bundy ..... 162/216
3,148,108 A * 9/1964 Cluett ..... 162/155
3,253,978 A * 5/1966 Bodendorf et al. ..... 162/152
3,598,696 A * 8/1971 Beck ..... 162/298
3,663,673 A 5/1972 Rionda
3,778,341 A 12/1973 Plummer et al.
3,993,828 A 11/1976 McCorsley, III
4,018,646 A * 4/1977 Ruffo et al. ..... 162/146
4,112,174 A 9/1978 Hannes et al.
4,318,774 A 3/1982 Powell et al.
4,425,399 A 1/1984 Bershas (Continued)

FOREIGN PATENT DOCUMENTS

DE 1 934 127 2/1970

(Continued)

*Primary Examiner* — Jose A Fortuna
(74) *Attorney, Agent, or Firm* — Robert D. Touslee

(57) ABSTRACT

A multilayer fibrous nonwoven mat containing at least one transition zone comprised of a mixture of the slurries used to form the layers on each side of the transition zone, the transition zone having a thickness of at least 1 percent of the thickness of the mat. At least one of the layers contains glass fibers. The multilayer mats are particularly useful as facers on gypsum wall board, insulating foam, a wood material and a broad range of other materials. The multilayer mats are made by a method that involves using a lamella in the forming box on a wet laid mat machine, between slurries, the lamella ending a significant distance prior to a moving forming wire. The transition zone or zones provide superior interlaminar shear strength and other properties compared to multilayer fibrous mats produced on wet laid machines having two or more separate forming boxes.

19 Claims, 3 Drawing Sheets

U.S. PATENT DOCUMENTS

| | | | | |
|---|---|---|---|---|
| 4,647,496 | A | 3/1987 | Lehnert et al. | |
| 4,681,802 | A | 7/1987 | Gaa et al. | |
| 4,810,576 | A | 3/1989 | Gaa et al. | |
| 4,824,524 | A * | 4/1989 | Hildebrand | 162/343 |
| 5,011,575 | A * | 4/1991 | Keller | 162/299 |
| 5,129,988 | A * | 7/1992 | Farrington, Jr. | 162/123 |
| 5,342,680 | A | 8/1994 | Randall | |
| 5,431,785 | A * | 7/1995 | Bubik et al. | 162/343 |
| 5,545,294 | A * | 8/1996 | Linden et al. | 162/343 |
| 5,704,179 | A | 1/1998 | Lehnert et al. | |
| 5,744,229 | A | 4/1998 | Gleason et al. | |
| 5,772,846 | A | 6/1998 | Jaffee | |
| 5,883,024 | A | 3/1999 | O'Haver-Smith et al. | |
| 6,059,929 | A * | 5/2000 | Dahl | 162/123 |
| 6,187,697 | B1 | 2/2001 | Jaffee et al. | |
| 6,432,482 | B1 | 8/2002 | Jaffee et al. | |
| 6,673,983 | B1 * | 1/2004 | Graef et al. | 604/378 |
| 6,686,054 | B2 * | 2/2004 | Nigam | 428/511 |
| 6,761,801 | B2 | 7/2004 | Ruf et al. | |
| 7,285,183 | B2 * | 10/2007 | Kajander et al. | 162/135 |
| 7,429,307 | B2 * | 9/2008 | Soderberg | 162/123 |
| 7,462,259 | B2 * | 12/2008 | Kajander et al. | 162/135 |
| 7,833,383 | B2 * | 11/2010 | Wilson et al. | 162/131 |
| 2003/0031854 | A1 | 2/2003 | Kajander et al. | 428/304.4 |
| 2003/0032350 | A1 * | 2/2003 | Kajander et al. | 442/76 |
| 2003/0139111 | A1 * | 7/2003 | Kajander et al. | 442/370 |
| 2003/0171727 | A1 * | 9/2003 | Graef et al. | 604/370 |
| 2004/0202832 | A1 * | 10/2004 | Nigam et al. | 428/195.1 |
| 2005/0034827 | A1 * | 2/2005 | Soderberg | 162/123 |
| 2005/0202742 | A1 | 9/2005 | Smith et al. | 442/256 |
| 2006/0016569 | A1 * | 1/2006 | Morin et al. | 162/145 |
| 2006/0099870 | A1 * | 5/2006 | Garcia et al. | 442/374 |
| 2007/0012414 | A1 * | 1/2007 | Kajander et al. | 162/129 |
| 2007/0264895 | A1 * | 11/2007 | Jaffee et al. | 442/340 |
| 2009/0163097 | A1 * | 6/2009 | Kajander | 442/118 |
| 2010/0273376 | A1 * | 10/2010 | Jaffee et al. | 442/17 |
| 2010/0319864 | A1 * | 12/2010 | Bhat et al. | 162/109 |

FOREIGN PATENT DOCUMENTS

| | | |
|---|---|---|
| DE | 2 657 942 | 8/1977 |
| EP | 0 138 657 | 4/1985 |
| EP | 1746209 A2 * | 1/2007 |
| GB | 1057054 | 2/1967 |
| GB | 0876037 | 8/1969 |

* cited by examiner

METHOD OF MAKING MULTILAYER NONWOVEN FIBROUS MATS

This application is a continuation of application Ser. No. 11/179,393, filed Jul. 12, 2005 now abandoned. The invention involves multilayer nonwoven mats having many uses, but being especially useful for bonding to various substrates and to stabilize and/or hide the substrate, such as the color of the substrate, when viewing from the mat side, and the laminates using these mats. These multilayer mats also have higher strength and smoother surfaces than single layer mats, even where the composition of the multilayer mat is the same in all layers and the same as the single layer mat. The invention also includes the method of making the multilayer mats. The mats are useful for hiding, stabilizing and/or reinforcing substrates f other products such as gypsum board, foam board, duct board, wallboard, fiber glass insulation, wood products, etc. The invention also includes a method for making the mats.

BACKGROUND

Machines having a moving, inclined forming wire are known for making nonwoven mats from fibers and it is known to use such a machine as manufactured by Voith GmBh and Sandy Hill Corp. for nonwoven mats as substrates in the manufacture of a large number of products and also as a facing for products like wallboard, foam board and insulation. Methods of making nonwoven mats by wet laid processes are described in U.S. Pat. Nos. 4,112,174, 4,681,802 and 4,810,576, the disclosures of which are hereby incorporated herein by reference. In these processes a slurry of glass fiber is made by adding fiber to a typical white water in a pulper to disperse the fiber in the white water forming a slurry having a very low fiber concentration to feed to the above machines where the fibers are deposited on the moving forming wire to form a wet web. The wet, nonwoven web of fiber is then transferred to a second moving screen in-line with the forming screen and run through a binder saturating station where an aqueous binder mixture, such as an aqueous urea formaldehyde (UF) resin based binder mixture, is applied to the mat in any one of several known ways. The mat, saturated with the binder, is then run over a suction section while still on the second moving screen to remove excess binder.

The wet mat is then transferred to a moving wire mesh belt, or a honeycomb drum, and run through an oven to dry the wet mat and to cure (polymerize) the UF based resin binder to bond the fibers together in the mat. Preferably, the aqueous binder solution is applied using a curtain coater or a dip and squeeze applicator, but other methods of application such as spraying are also known.

In the drying and curing oven the mat is subjected to temperatures up to 450 or even 550 degrees F. or higher for periods usually not exceeding 1-2 minutes and as little as a few seconds. Alternative forming methods for nonwoven fiber mats include the use of well known processes of cylinder forming, continuous strand mat forming which lays continuous strands of glass fibers in overlapping swirls, and "dry laying" using carding or random fiber distribution.

The fastest and widest of the wet forming machines described above use a very large pump to feed the fibrous slurry to the forming box because of the high degree of dilution needed to keep the fibers well dispersed and to achieve the degree of uniformity of fibrous structure needed for the end use of the nonwoven mats. On existing machines, the productivity of the mat line is being limited by the size of the pump available, and the practicality of larger pumps for this purpose. If a higher feed rate of the dilute aqueous slurry to the forming box could be achieved reasonably, the productivity of the mat line could be increased substantially producing a significantly lower fixed cost per capacity unit and also a significantly lower direct cost per capacity unit. Also, since much of the market for nonwoven mats, roofing, is very seasonal and inventory is relatively low density and very bulky, an increased mat capacity per line, per crew, per location, etc. would also provide a significant competitive advantage during the peak demand times.

Wet forming machines having two or more separate forming systems with separate forming boxes are also known and it is known to use such machines to make multilayer, nonwoven mats. In such machines, one layer is formed on the moving, inclined wire, and then a second layer, of a different composition, is formed on top of the first layer with the first layer being exposed to the air for a very short time. Multilayer mat made on such machines have a clear line of demarcation between the layers and this can lead to delamination and other shortcomings. It is known in U.S. Pat. No. 3,778,341, to "piggyback" two forming boxes such that the first layer is not exposed to the air before a second layer is formed against the first layer, but there is still a clear line of demarcation between the two layers.

It is now known as shown in U.S. Pat. No. 6,761,801, to make a forming box having one or more separators therein, each separator called a lamella. The lamella can be made of a flexible polymer membrane and doesn't extend all the way to the moving forming wire. A separate, dilute particulate and/or fibrous aqueous slurry can be fed to each section of the forming box using separate feed pipes and headers. In such machines there is some blending of the two separate slurries at the interface before reaching the forming wire such that there is not such a clear line of demarcation between the layers as the multilayer mats described in the previous paragraph. However, such a machine is known for use only in making paper, tissue or cardboard.

SUMMARY

The invention comprises a multilayer mat comprising two or more layers, each layer having a different or the same composition, and having one or more portions of the mat thickness, one or more transition zones, between layers that is comprised of a blend of the compositions of the each of the adjacent layers, at least one of the layers comprised of a major portion of fibers bonded together with a resinous binder. The invention also includes a method of making a multilayer mat comprising two or more layers, each layer having a different composition or the same composition, and having an portion of thickness of the mat, a transition zone, between two layers comprising;

a) forming a first dilute, aqueous slurry containing fibers, b) forming at least a second dilute, aqueous slurry comprising particles and/or fibers, c) feeding the first slurry to a first section of a forming box containing a lamella inside the forming box such as to separate the first section from a second section only a portion of the distance from a back of the forming box to a moving forming wire, there being no separation between the first section and the second section past an end of the lamella, d) feeding the second slurry to the second section of the forming box, e) forming a wet web on the moving forming wire, f) transferring the wet web to a second moving permeable belt and subject the wet web to heat to dry the web and form a bond between the particles and/or fibers in the multilayer mat.

A modification of the above method can be used to produce a multilayer mat having a homogenous composition by feeding the same fibrous slurry to each of two sections of the forming box to greatly increase the productivity of the forming line and to overcome the problem of inadequate pumping capacity described in the background above. Adding a second slurry prep system, feed pipe, header and a new forming box containing two sections separated partially with a lamella produces a substantially higher feed rate of the dilute aqueous slurry to the new forming box while the moving forming wire and the rest of the line requires only nominal modification, such as faster drives and possibly larger oven fan(s) and a larger binder pump. The present binder pump is relatively small, so enlarging this pump is not a problem. With such changes, the productivity of the mat line is increased substantially producing a significantly lower fixed cost per capacity unit and also a significantly lower direct cost per capacity unit. Much of the market for nonwoven mats is in roofing products that are very seasonal and mat inventory is relatively low density and very bulky, so increased mat capacity per line, per crew, per location, etc. also provides a significant competitive advantage during the peak demand times.

A modification of the above methods comprises splitting the feedstock prepared by one of the two stock systems into two parts, equal or unequal, and feeding one of the parts to a first section of a three section forming box and the other part to another section of the forming box. The feedstock from the other stock preparation system is fed to a third section of the forming box to form a three layer mat with two transition zones. Two of the layers will be of the same composition and the two transition zones will be of similar composition. Most typically there is a lamella between each section and an adjoining section of the forming box, but a lamella can be used in the forming box, i.e., between only one set of two adjoining sections. In the latter case the thickness of a transition zone formed in the absence of a lamella will be thicker than the transition zone formed at the end of the lamella. Also in this invention, three separate stock preparation systems can be used to produce three different feedstocks to make a three layer mat with two transition zones, each layer of mat and each transition zone being of a different composition.

The multilayer mats containing glass fibers and produced by these methods are superior and unlike mats produced heretofore because of the transition zone or zones that contain a blend of the ingredients in the two adjacent layers. These mats have superior interlaminar strength and integrity and other advantages because of one or more transition zones that have a thickness of at least one percent of the thickness of the dry, finished mat, more typically a thickness in the range of 2-10 percent of the thickness of the finished mat. More typically the thickness of the transition zone is in the range of about 3-10 percent of the finished mat thickness and most typically in the range of about 4-10 percent. The thickness of each transition zone can be greater than 10 percent of the thickness of the finished mat, but this is not normally any further advantage over 1-10 percent.

When the word "about" is used herein it is meant that the amount or condition it modifies can vary some beyond that stated so long as the advantages of the invention are realized. Practically, there is rarely the time or resources available to very precisely determine the limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors' disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term "about" as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

DETAILED DESCRIPTION

Figure 1:
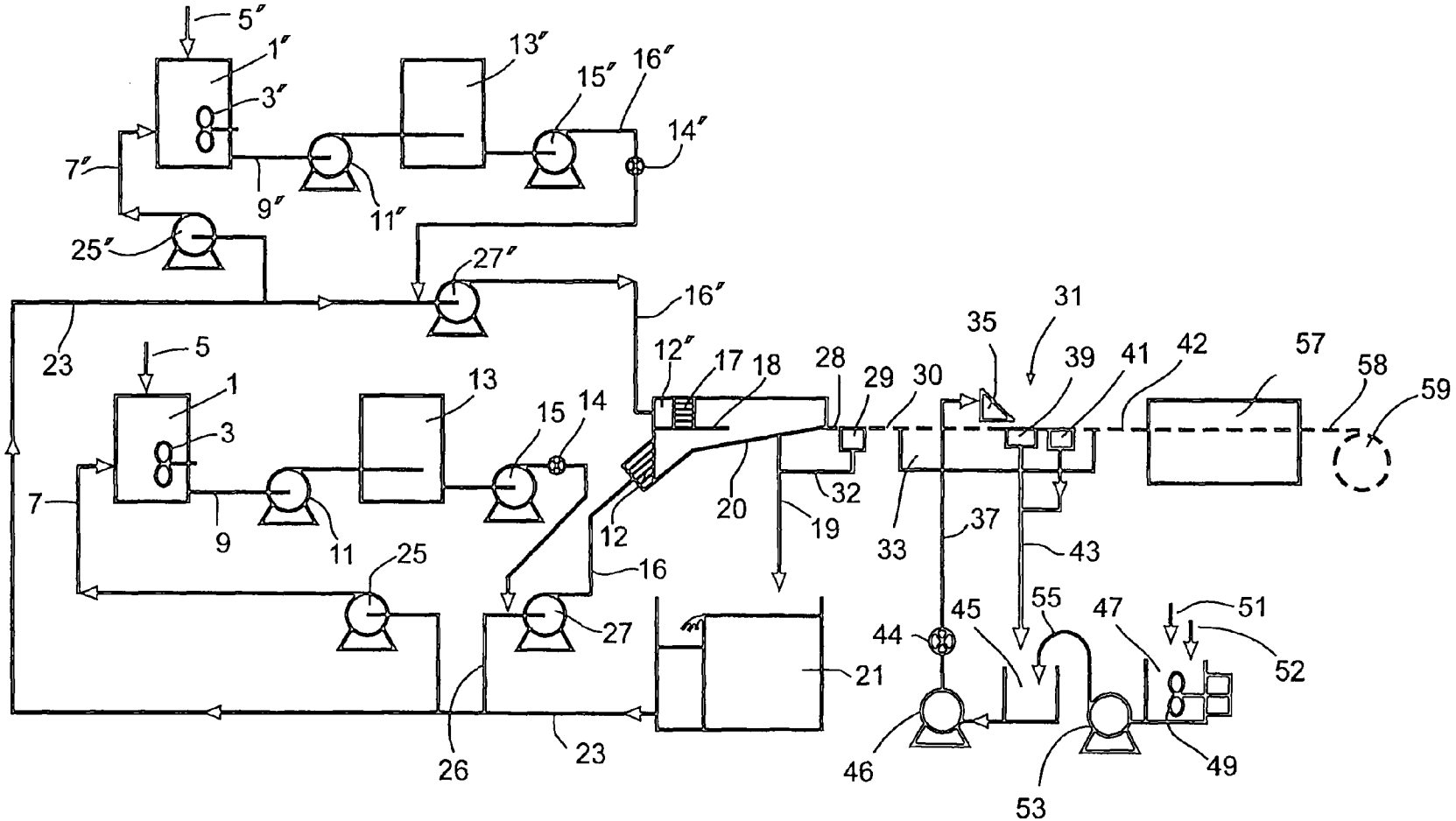
FIG. 1 is a schematic drawing of a typical wet forming system used to practice the invention.

The mats of the invention have at least two layers with a transition zone between the layers that is comprised of a mixture of the ingredients of both layers. The thickness of the transition zone can vary by the shape of the lamella, as is known, but is usually quite thin, such as in a range of about 3 mm to about 8 mm. At least one of the layers is comprised of a major portion of fibers, most typically glass fibers, but the fibers can be of any kind including, but not limited to polymer fibers, natural fibers, ceramic fibers, mineral wool, carbon fibers and cellulosic fibers or fibers derived from cellulose, and mixtures of any two or more these fibers. The glass fibers can be E glass, C glass, T glass, S glass or any known glass fiber of good strength and durability in the presence of moisture and up to at least about 1.5-3 inches in length. Normally the glass fibers used all have about the same target length, such as 0.25, 0.5, 0.75, 1 or 1.25 inch, but fibers of different lengths and different average diameters can also be used to get different characteristics in a known manner. Fibers up to about 3 inches in length can be used in a wet process for making glass fiber mats and even longer fibers can be used in some dry processes. Generally, the longer the fiber, the higher the tensile and tear strengths of the mat, but the poorer the fiber dispersion. Microfibers having average, or mean diameters below about 3 microns are particularly useful to make mats having very small openings and/or smoother surfaces. Generally, additions of polymer fibers to glass fibers make the mats improve flexibility, bend strength, and tear strength. Generally, additions of glass fibers to polymer fibers give the mat more stability and stiffness and fire resistance.

Any of the binders used to bond fibers together in nonwoven mats can be used in the invention, typically resins that can be put into aqueous solution or an emulsion latex. Typical resin based binders meeting this description are polyvinyl alcohol, carboxyl methyl cellulose, hydroxyl ethyl cellulose, lignosulfonates, urea formaldehyde resins, alone or modified in known ways to plasticize the resin and to provide higher wet strengths, acrylic resins, polyvinyl acetate, melamine formaldehyde, phenol formaldehyde, polyvinyl chloride, vinyl acetate, polyurethane, styrene-butadyene-rubber, cellulose gums and other similar resins. Of these, conventional modified urea formaldehyde resins are most typical because of their cost, bonding strength to fibers, particularly glass fibers, and acceptability for various applications.

Particles can be included in the dilute aqueous slurry used to form one or more layers. Typical types of particles are fillers, whitening or coloring pigments, carbon particles, thermoplastic polymer particles, intumescent particles, anti-fungal particles, metal particles, pesticides, herbicides, glass microspheres or particles, or phase change particles, i.e. particles that absorb heat or release heat due to a phase change in the temperature range of the mat application. The particles can be of a broad size range such as between about a few microns up to almost the thickness of the mat, but typically are in the range of a few microns up to about 4 mm in diameter, more typically up to about 3 mm or even up to about 1-2 mm in diameter. The particle size of the particles will usually be determined by the material being used and its purpose. Some materials, like clay, typically break down, slake, in water and the slurry preparation to produce a significant percentage of particles of only a few microns in diameter, while other materials like ground limestone will not be significantly reduced by the slurry forming process beyond their beginning particle size. Normally it is desirable that the particles be large enough that most will remain in the mat during the forming of the mat and not stay in the aqueous medium.

Two or more dilute aqueous slurries of are prepared in a known manner, such as disclosed in U.S. Pat. Nos. 4,112,174, 4,681,802 and 4,810,576, which references are hereby incorporated into this disclosure by reference, but any known method of making slurries for nonwoven mats are suitable for use in the invention. The slurries are pumped to manifolds on a forming box and deposited onto an inclined moving screen forming wire to dewater the slurries sequentially and form a multilayer wet nonwoven fibrous web or mat, on machines like a Hydroformer™ manufactured by Voith—Sulzer of Appleton, WS, or a Deltaformer™ manufactured by Valmet/Sandy Hill of Glenns Falls, N.Y. The examples disclosed herein were made on a pilot scale model of a wet forming machine, binder applicator, and oven that produces a mat very similar to a mat that would be produced from the same slurry and binder on a production sized Voith—Sulzer Hydroformer™ with a curtain coater binder applicator and a flat bed, permeable conveyor type convection dryer.

After forming a web from the fibrous slurry, the wet, unbonded fibrous nonwoven web or mat is then transferred to a second moving screen running through a binder application saturating station where the binder, preferably resin based, in aqueous solution is applied to the mat. The excess binder is removed, and the wet mat is transferred to a moving permeable belt that runs through a convection oven where the unbonded, wet mat is dried and cured, to bond the fibers together in the mat. In production, the dry, cured mat is then usually wound into rolls and packaged such as by stretch or shrink wrapping or by putting into a plastic bag to keep out moisture and dirt, etc.

Preferably, the aqueous binder solution is applied using a curtain coater or a dip and squeeze applicator. In the drying and curing oven the mat is heated to temperatures of about 350 degrees F., but this can vary from about 250 degrees F. to as high as will not embrittle or deteriorate the binder, depending upon the type of resin binder used, for periods usually not exceeding 1 or 2 minutes and frequently less than 40 seconds, preferably significantly less than 30 seconds.

FIG. 1 is a schematic of a typical wet former system for making multi-layer nonwoven mats except that it contains two stock preparation systems. Fibers, particulate or both 5 are fed, typically continuously, but batch type preparation is also used, into a first pulper 1 containing forming liquid, usually a known aqueous forming liquid flowing in a return pipe 7. Mixing takes place in the pulper 1 with an agitator 3 to form a concentrated slurry that exits the pulper 1 through pipe 9 and into a pump 11 that pumps the concentrated slurry into a holding tank 13. The forming liquid is delivered to pipe 7 by pump 25, pumping the forming liquid coming from a pipe 23 and a deairing tank 21. Concentrated slurry is metered out of the holding tank 13 by a pump 15 and variable flow valve 14 where the concentrated slurry is diluted substantially with the forming liquid coming through pipe 26 to a forming pump 27. The substantially diluted slurry, usually having a solids concentration of less than about 0.04 percent, flows through pipe 16 to a distribution manifold 12 on a forming box 17.

A second slurry preparation system, like or similar to the first slurry preparation system is also shown. Fibers 5', with or without particulates, are fed, preferably continuously, into a first pulper 1' containing forming liquid, usually a known aqueous mixture coming from a return pipe 7' where mixing takes place with an agitator 3' to form a concentrated slurry that exits the pulper 1' through pipe 9' and into a pump 11' that pumps the concentrated slurry into a holding tank 13'. The forming liquid is delivered to pipe 7' by pump 25', pumping the forming liquid coming from the pipe 23 fed from the deairing tank 21. Concentrated slurry is metered out of the holding tank 13' with a pump 15' and a variable flow valve 14' where the concentrated slurry is diluted substantially with the forming liquid coming through pipe 23 into a second forming pump 27'. The substantially diluted slurry, usually having a solids concentration of less than about 0.04 percent, is pumped through pipe 16' to a distribution manifold 12' on the forming box 17.

The forming box 17 contains one or more lamellae 18 that will be described in more detail later. The slurries flow toward a moving permeable forming belt 20 where the fibers and any particulates in the slurries are formed into a wet, nonwoven web while the forming water flows through the forming belt as return forming liquid 19 and onto the deairing tank 21. A final suction box 29 under the forming belt 20 near where the wet web is removed from the forming belt 20 removes excess forming liquid from the wet web and returns it through pipe 32 to the deairing tank 21. The wet web is then transferred to a second moving permeable belt 30 which carries the wet web under a binder applicator 35 where binder is applied in a binder application section 31. Excess binder is removed from the wet web or mat with suction boxes 39 and 41 to deduce the binder level in the mat to the desired level. The bindered mat is then transferred to an oven belt 42 and passed through an oven 57 where the mat is dried and the resin(s) in the binder cured. The dry mat 58 can then be wound into a roll 59 for packaging, shipment and use or storage.

The mat is bound together with a resinous binder in a known manner. The binder is usually an aqueous mixture of water and one or more resins or polymers and other additives in a solution, emulsion or latex as is known. The binder is prepared by adding one or more resinous materials 51 with a liquid 52, normally water, to a mix tank 47 containing an agitator 49. Excess binder removed from the bindered mat with suction boxes 39 and 41 can also be added to the mix tank 47 by way of return pipe 43. The mixed binder is then pumped with pump 53 to a binder holding tank 45 to supply a binder applicator pump 46 that meters the binder at the desired rate using variable valve 44 to the binder applicator 35.

Figure 2:
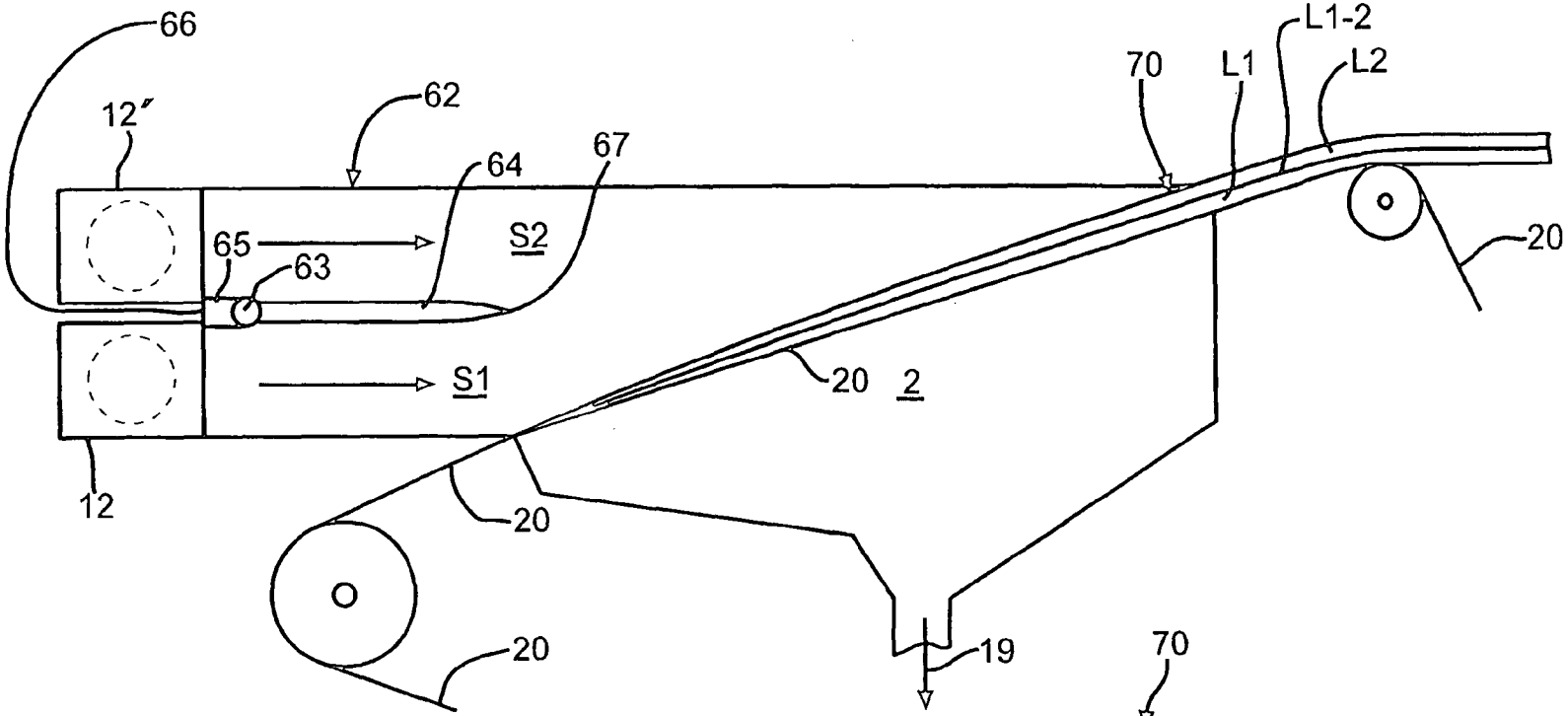
FIG. 2 is a partial vertical cross section of the forming area of the system shown in FIG. 1 showing one typical forming box used in the invention.

FIG. 2 shows a typical forming box 62, representing the forming box 17 in FIG. 1, containing a lamella 64 with an end portion 67. The lamella 64 is typically a polymer membrane material and is like that disclosed in U.S. Pat. No. 6,761,801, the disclosure being incorporated herein by reference. The lamella 64 can optionally be rigid and pivotly mounted at pivot 63 to a bracket 65 attached to a back wall 66 of the forming box 62. Even if not pivotly mounted, the flexibility of the lamella 64 will allow the lamella to adjust to differing flow rates and pressures to automatically adjust to provide good formation on the moving forming wire 20. A first slurry S 1 is fed to the manifold 12 on the back of the forming box 62 and the manifold is constructed in a known manner to distribute the slurry evenly across the width of the forming box 62. A second slurry S 2 is fed to the manifold 12', usually constructed in the same manner as the manifold 12. The first slurry S 1 and the second slurry S 2 flow into the forming box 62 in a generally laminar manner towards the forming wire 20, separated from each other for most of the distance by the lamella 64. The low concentration stocks S 1 and S 2 flow to the forming wire 20 where the water flows through the forming wire 20 in a conventional manner and into a plurality of conventional suction or forming boxes 2 to form the mat 70. A first layer L 1 is formed on the forming wire (screen) 20 from the solids in slurry S 1. Because the lamella 64 ends a significant distance from the forming wire 20, and due to some turbulence still existing in the slurries S 1 and S 2 at their interface at the end portion 67 of the lamella 64 and after leaving the end portion 67, there is some mixing of the two slurries S 1 and S 2 before reaching the forming wire 20. This results in a thin transition zone L 1-2 (FIG. 3) being formed on top of layer L 1, the transition zone L 1-2 containing a mixture of the solids in both S 1 and S 2. Immediately, a layer L 2 begins to form on top of the transition zone L 1-2, forming a wet web 70.

The thickness of the transition zone L 1-2 can be varied by changing the shape of the end portion 67 of the lamella to cause more or turbulence at the end of the end portion 67 and/or by changing the distance between the end of the end portion 67 of the lamella and the forming wire 20. The thickness of the transition zone L 1-2 should be at least about 1 percent of the thickness of the mat 70, but can be thicker by adjusting the thickness affecting parameters mentioned in the previous sentence and can be up to at least about 10 percent of the thickness of the mat. These mats have superior interlaminar strength and integrity and other advantages because of one or more transition zones that have a thickness of at least one percent of the thickness of the dry, finished mat, more typically a thickness in the range of 2-10 percent of the thickness of the finished mat. More typically the thickness of the transition zone is in the range of about 3-10 percent of the finished mat thickness and most typically in the range of about 4-10 percent. The thickness of each transition zone can be greater than 10 percent of the thickness of the finished mat, but this is not normally any further advantage over 1-10 percent.

Figure 3:
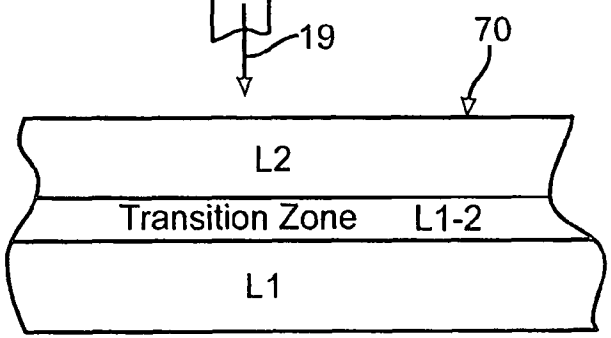
FIG. 3 is a partial cross section of a typical nonwoven mat of the invention and made according to the invention.
Figures 4, 5:
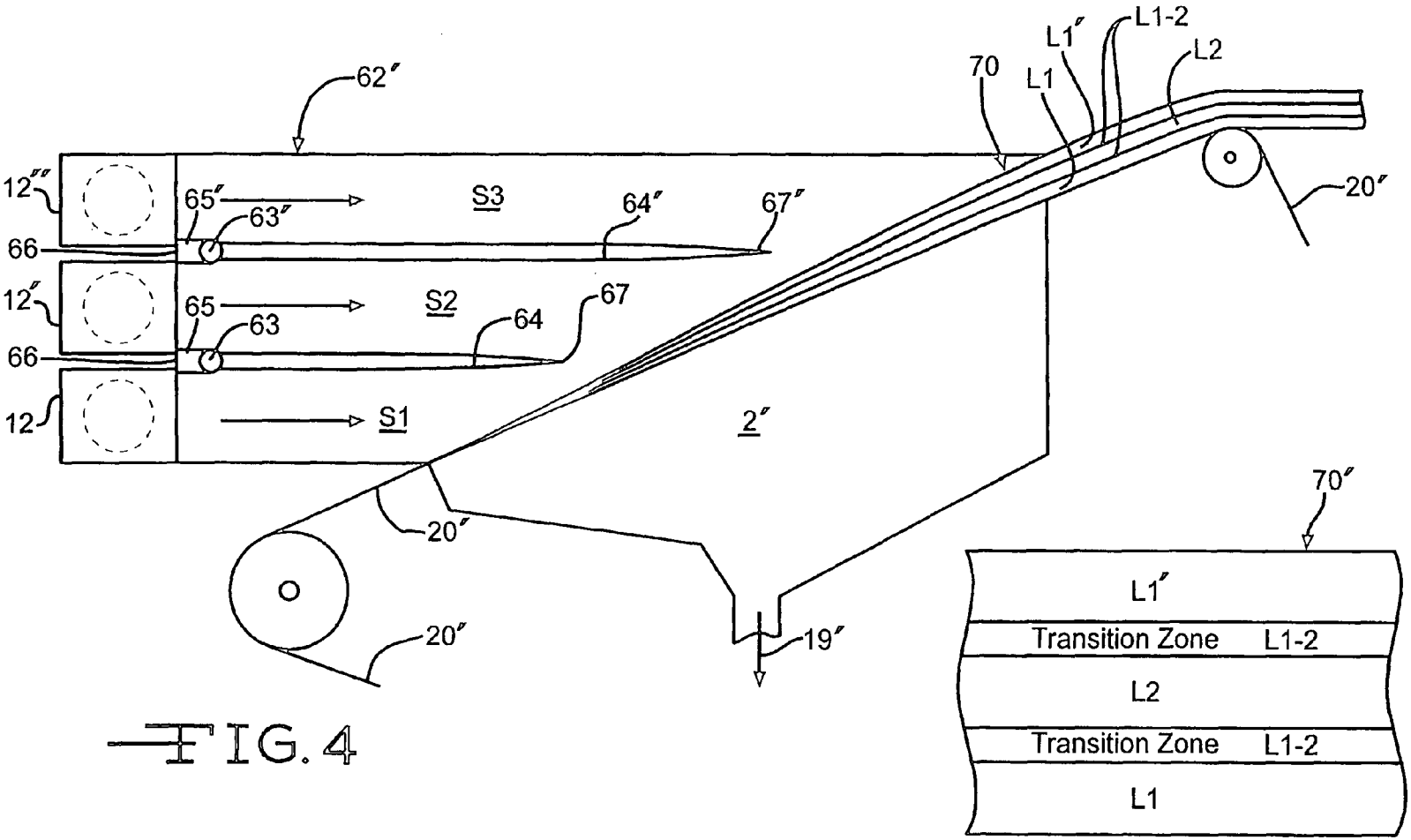
FIG. 4 is a partial vertical cross section of the forming area of a different embodiment of the system shown in FIG. 1 showing another typical forming box used in the invention.
FIG. 5 is a partial cross section of a typical nonwoven mat of the invention and made according to the invention in the system shown in FIG. 4.

FIGS. 4 and 5 show the same kind of apparatus and a multilayer product except that a forming box 62' contains three manifolds and forming sections 12, 12' and 12", two lamella 64 and 64', and three stocks, S 1, S 2 and S 3. The compositions can be different in each of the stocks or two or three of the stocks can have the same composition. The latter can be achieved with two stock preparation systems and a splitter valve that splits one of the stocks into two parts with one part being fed to manifold 12 and the other part being fed to the manifold 12". In this way, a multilayer mat 70 can be formed on the forming wire 20' having a first layer L 1, a first transition zone L 1-2, a core layer L 2, a second transition zone, also L 1-2, and a top layer L 1', the layer L 1' having the same composition as the layer L 1, but not necessarily the same thickness of as layer L 1 or L 2. In this way many types of multilayer mats can be made including a mat having a core layer L 2 that can be contain longer and/or coarser fibers providing greater tensile and tear strength, and lower cost, with at least one of the layers L 1 and/or L 1' comprised of fine and/or shorter fibers providing a smooth and more user friendly surface than current monolithic mats and cheaper than monolithic mats comprised of fine fibers to achieve at least one smooth surface. Many other mat combinations can be made using the system shown in FIG. 4 as will be recognized the skilled artisan. The thickness of the transition zones in the mat shown in FIG. 5 are the same as described for the mat of FIG. 3.

UF resins, usually modified with one or more of acrylic, styrene butadiene, acrylic copolymer or vinyl acetate resins, are most commonly used as a binder for glass fiber mats because of their suitability for the applications and their relatively low cost. Melamine formaldehyde resins are sometimes used for higher temperature and/or chemical resistant applications. To improve the toughness of the mats, a combination of higher mat tear strength and mat flexibility, which is needed to permit higher processing speeds on product manufacturing lines and for maximum product performance on the roofs and in other applications, it is common to modify or plasticize the UF resins as described above. The binder content of these finished mats typically are in the range of 15 to 35 weight percent or higher, based on the dry weight of the mat. It is also known to use other types of aqueous latex binders like acrylics, polyester, polyvinyl acetate, polyvinyl alcohol and other types of resinous binders alone or in combination.

Nonwoven mats of the invention are comprised of at least one layer comprising glass or polymer fibers bonded together with an aqueous binder system containing a conventional resin binder, preferably a water soluble binder like one or more of those described above. One or both layers can contain particles of a polymer or resin, a paper coating material like a clay, powdered limestone, polymer, glass, and ceramic microspheres, and other conventional white paint pigments, such as titania, colored pigments, carbon, and other functional particles like fungicides, herbicides, pesticides, intumescent materials. Some preferred opacifiers are ROPAQUE®, hard acrylic/styrene copolymer microspheres available from Rohm and Haas of Philadelphia, Pa., Nova-Cote PC™ clay based coatings available from the Georgia-Pacific Corporation of Atlanta, Ga., and titania pigments available from many sources such as SUPER SEATONE® Titanium White supplied by BF Goodrich of Cincinnati, Ohio. Mats of the invention comprise a layer that contains 0-20 weight percent, typically 1-20 wt. percent, more typically about 3-15 wt. percent, most preferably 5-10 wt. percent, based on the dry weight of the mat resin binder, of one or more particles.

The fibers can be selected from a group consisting of glass, polymer, natural materials, cellulosic, fibers derived from cellulose or cellulosic materials, mineral wool, ceramic fibers, carbon fibers and naturally occurring fibers. The glass fibers can be of any reasonable composition and typically is E glass, but glass microfibers of C glass are also particularly useful in the invention. The fibers can be staple fibers, like microfibers or even coarser insulation fibers and cellulosic fibers and chopped fibers of similar or a blend of different lengths. Chopped glass fibers having diameters of about 6 to about 23 microns are particularly useful in the invention, more typically about 8-20 microns and most typically about 10 to about 17 microns, and lengths from about 0.12 inch to about 3 inches, more typically from about 0.25 to about 1.5 inches and most typically from about 0.5 to about 1.25 inch long are particularly useful in the invention. Any polymer fiber is useful in the invention, but typically the diameters are greater than those of glass fibers and the lengths will usually be shorter to get good dispersion. Polymer fibers useful typically include polyester, polyethylene, nylon, Kevlar®, polyvinyl chloride, and polyacrylnitrile (PAN).

Nonwoven fibrous mats are often used as facers for foam board, gypsum wall board, chipboard and other wood products, glass fiber insulation blanket and for pressed glass fiber insulation boards and duct liner to present a more pleasing surface and/or a surface that is easier to paint or coat to form an attractive or functional surface. Often it is desirable that the mat facer hide the yellow, or other color of the cured insulation substrate, presenting a white surface, but normal glass fiber mat does not cover up the color to the desired extent due to the light transmission of the 10-16 glass fibers normally used in the mat. It is possible to increase the hiding power by adding small diameter glass microfibers, having average diameters of about 2 microns or less, to the mat but this adds considerable cost to the mat, makes the mat weaker and fuzzier and increases the amount of scrap when making this mat due to wrinkling problems.

It is also known, as illustrated by U.S. Pat. No. 5,965,257 to make a mat having zero bleed through when used as a facer mat in the manufacture of foam insulation by heavily coating a dry, bonded mat on a separate coating line. This patent teaches a coating composition comprising one or more fillers and a binder like acrylic latex. It is also known to use off-line coating to make mats having good hiding properties, but off line coating is expensive, often producing a mat that is not cost competitive with alternative facers like Kraft fiber papers and plastic films. Although glass fiber, and sometimes polymer fiber, nonwoven mats are superior in other aspects such as durability, thermal and humidity stability, they often loose out to the lower cost alternatives.

When the entire mat is made with the materials necessary to achieve the hiding power, smooth surface, or a barrier to bleed through, the cost is often non-competitive, and/or the strength properties of the mat are inferior to what is needed. This is problem is often addressed by coating a nonwoven mat to provide the surface quality needed while the base mat provides the best cost and strength characteristics available, but the coating step is very costly because it is usually done off line in a separate process requiring more investment, more handling, labor, etc. One way of overcoming this problem is disclosed in U.S. Pat. No. 6,432,482, and the invention described here provides another solution that offers even more opportunities. For example, a base layer making up a majority of the thickness of the mat using relatively coarse fibers and having good strength characteristics can be made with a top layer of finer fibers and/or particulates to provide a tight and smooth surface. Normally such a diversity of compositions might tend to delaminate with time and/or stress but when made according to the invention with a transition zone between the two diverse layers, any tendency to delaminate is overcome. In another application of the invention, a relatively thick core layer of relatively inexpensive coarse fibers is coupled with thin surface layers of finer fibers to produce a mat having low cost and good strength characteristics. One or both of the surface layers can also comprise microfibers and/or particles to have a smooth surface and good barrier properties.

Another application is to make a homogeneous mat by feeding the same slurry composition to both headers in a two header machine having one or more lamellae in the forming box. Because of the very low solids concentration of the slurries used to make long fiber nonwoven mats, the pump 27, FIG. 1, must be very large. For the largest machines in the industry, i.e. widest and fastest, the pump 27 limits how fast the machine can be run and therefore its productivity. Larger pumps present cost and technical barriers for this use. The invention overcomes this limitation by placing two pumps 27 and 27' in parallel, using one or two slurry preparation systems. This overcomes the pumping bottleneck and substantially increases the productivity of a machine, obtained by higher running speeds, a wider machine or a machine that is both faster and wider. The resultant mat is more uniform in permeability and optical density and smoother due to the staged layering of the fibers compared to the more random layering in a typical single layer forming box.

The following examples illustrate some specific embodiments of the invention.

Example 1

An aqueous slurry containing 1.25 inch long, M137 wet chopped strand fiber, an E glass fiber (16 micron average diameter) product available from the Johns Manville Corp. of Denver, Colo., was fed to a conventional forming box to form a homogeneous mat in a conventional manner. An urea formaldehyde aqueous resin modified with 7.5 wt. percent vinyl acrylic acetate in a known manner was applied to the wet web to produce a nominal binder content of 22 wt. percent and the bindered mat was dried and heated to a temperature of about 380 degrees F. to cure the binder. This mat had a good appearance and good fiber formation the following properties:

| | |
|---|---|
| Thickness (mils) | 30.5 |
| Basis weight (gms/sq. ft.) | 8.4 |
| Loss on Ignition (LOI) (%) | 22.3 |
| Tensile (lbs/3 in. width) | |
| Machine Direction | 123.5 |
| Cross Mach. Dir. | 77.2 |
| Flex Tensile* (lbs/3 in.) | |
| MD | 98.1 (79.4% of MD tensile) |
| CMD | 78.7 (100% of CMD tensile) |
| MD Tear (gms) | 388 |
| CMD Tear (gms) | 659 |
| Air permeability (CFM) | 880 |

*The test involves bending a strip of mat 180 degrees around a 0.125 inch diameter hinge and then testing the tensile strength to determine any change from an unbent sample of the same mat. This test indicates the flexibility or brittleness of the mat and also indicates the ability of the mat to conform to a different shape.

The mat of this example represents a typical conventional single layer shingle type mat in physical properties.

Example 2

The aqueous slurry of Example 1 was fed to both manifolds of a two-manifold headbox containing a lamella, like shown in FIG. 2, to form a homogeneous mat. An urea formaldehyde aqueous resin modified with 7.5 wt. percent vinyl acrylic acetate in a known manner was applied to the wet web to produce a nominal binder content of 22 wt. percent and the bindered mat was dried and heated to a temperature of about 380 degrees F. to cure the binder. This mat had a good appearance and good fiber formation the following properties:

| | |
|---|---|
| Thickness (mils) | 30.2 |
| Basis weight (gms/sq. ft.) | 8.6 |
| Loss on Ignition (LOI) (%) | 22.8 |
| Tensile (lbs/3 in. width) | |
| Machine Direction | 134 |
| Cross Mach. Dir. | 70 |
| Flex Tensile (lbs/3 in.) | |
| MD | 120 (90% of MD tensile) |
| CMD | 61 (86.6% of CMD tensile) |
| MD Tear (gms) | 306 |
| CMD Tear (gms) | 506 |
| Air permeability (CFM) | 906 |

This mat represents how a homogeneous mat is made on according to the invention in an embodiment that produces substantially higher productivity with the same size, or even smaller, pumps than are used today or the largest inclined wire machines making glass fiber nonwovens. The properties of this mat were within the normal variation for this product.

Example 3

A first slurry was made according to Example 1. A second slurry was made using the same procedure except that ¾ inch long K137 chopped strand fiber (13 micron) product, also available from Johns Manville Corp., was used instead of the M137 chopped strand fiber product. The first slurry was fed to a first manifold at the same rate as the second slurry was fed to a second manifold. The resultant wet web was treated to the same binder described in Example 1. The resultant bindered mat was dried and heated to 380 degrees to cure the binder. The resultant multilayer mat had the following properties.

| | Example 1 | Example 3 |
|---|---|---|
| Thickness (mils) | 30.8 | 32.4 |
| Basis weight (gms/sq. ft.) | 8.4 | 8.7 |
| Loss on Ignition (LOI) (%) | 22.3 | 23 |
| Tensile (lbs/3 in. width) | | |
| Machine Direction | 123.5 | 132 |
| Cross Mach. Dir. | 77.2 | 81 |
| Flex Tensile* (lbs/3 in.) | | |
| MD | 98.1 (79.4% of MD tensile) | 114 (86.7%) |
| CMD | 78.7 (100% of CMD tensile) | 74.6 (92%) |
| MD Tear (gms) | 388 | 351 |
| CMD Tear (gms) | 659 | 574 |
| Air permeability (CFM) | 880 | 846 |

The physical properties of this multilayer mat were very similar to and within the normal variation of the standard mat of Example 1, but one surface of this mat, the surface made with the second slurry, was much more smooth that the other surface and had smaller openings between the fiber. The smoother surface is better suited to coating and thus this mat can be used to replace a standard mat made entirely with the more costly K137 product for applications involving coated mat.

Example 4

A first slurry was made according to Example 1. A second slurry was made using the same procedure as Example 2 except that 1 inch long 6 denier polyester fiber was used in place of the M137 product. The first slurry was fed to a first manifold at a rate 7 times the rate that the second slurry was fed to a second manifold. The resultant wet web was treated to the same binder described in Example 1, but excess binder was removed to the extent to achieve an LOI of about 32 wt. percent. The resultant bindered mat was dried and heated to 300-325 degrees to cure the binder. The resultant multilayer mat had the following properties.

| | Example 1 | Example 4 |
|---|---|---|
| Thickness (mils) | 30.8 | 37.4 |
| Basis weight (gms/sq. ft.) | 8.4 | 8.6 |
| Loss on Ignition (LOI) (%) | 22.3 | 32 |
| Tensile (lbs/3 in. width) | | |
| Machine Direction | 123.5 | 87.6 |
| Cross Mach. Dir. | 77.2 | 70 |
| Flex Tensile* (lbs/3 in.) | | |
| MD | 98.1 (79.4% of MD tensile) | 89 (100%) |
| CMD | 78.7 (100% of CMD tensile) | 72 (100%) |
| MD Tear (gms) | 388 | 574 |
| CMD Tear (gms) | 659 | 647 |
| Air permeability (CFM) | 880 | 873 |

This mat had superior flexibility, flex bend strength retention and tear strength to the all glass fiber mat and was much less expensive than if the entire mat had contained about 9.5 wt. percent of the polyester fibers. The surface of the layer containing the polyester fibers was also more user friendly, less abrasive, than the surface of the glass fiber layer.

From this example, other embodiments are mats having three layers and two transition zones using the forming box shown in FIG. 3. The top and bottom layers will represent about 5-15 wt. percent of the mat and will be comprised of polyester fibers and the middle layer making up about 80-90 wt. percent of the mat will be comprised of 1-1.5 inch long glass fibers having average fiber diameters in the range of about 12 to about to about 18 microns, more typically about 13 to about 16 microns with binder contents in the range of about 15 to about 35 wt. percent, more typically in the range of about 20 to about 32 wt. percent.

Example 5

A first slurry was made according to Example 1. A second slurry was made using the same procedure as Example 2 except that equal parts of 1 inch long 6 denier polyester fiber and the M137 product of Example 1 was in this second slurry. The first slurry was fed to a first manifold at a rate 4 times the rate that the second slurry was fed to a second manifold. The resultant wet web was treated to the same binder described in Example 1, but excess binder was removed to the extent to achieve an LOI of about 30 wt. percent. The resultant bindered mat was dried and heated to 370-380 degrees to cure the binder. The resultant multilayer mat had the following properties.

| | Example 1 | Example 5 |
|---|---|---|
| Thickness (mils) | 30.8 | 38.3 |
| Basis weight (gms/sq. ft.) | 8.4 | 8.8 |
| Loss on Ignition (LOI) (%) | 22.3 | 30 |
| Tensile (lbs/3 in. width) | | |

-continued

| | Example 1 | Example 5 |
|---|---|---|
| Machine Direction | 123.5 | 96 |
| Cross Mach. Dir. | 77.2 | 80 |
| Flex Tensile* (lbs/3 in.) | | |
| MD | 98.1 (79.4% of MD tensile) | 89.7 (93.3%) |
| CMD | 78.7 (100% of CMD tensile) | 74.4 (92.7%) |
| MD Tear (gms) | 388 | 555 |
| CMD Tear (gms) | 659 | 550 |
| Air permeability (CFM) | 880 | 886 |

This mat also had excellent flexibility, flex bend tensile retention and tear strengths and was even less expensive than the mat of Example 4.

Example 6

An aqueous slurry containing four parts ¾ inch long, K137 wet chopped strand fiber, an E glass fiber (13 micron average diameter) product and one part 0.5 inch long H137 wet chopped strand fiber (10 micron average diameter) product available from the Johns Manville Corp. of Denver, Colo., was fed to a conventional forming box to form a homogeneous mat in a conventional manner. An urea formaldehyde aqueous resin modified with 7.5 wt. percent vinyl acrylic acetate in a known manner was applied to the wet web to produce a nominal binder content of 24 wt. percent and the bindered mat was dried and heated to a temperature of about 380 degrees F. to cure the binder. This mat had a good appearance and good fiber formation the following properties:

| | Example 1 | Example 7 |
|---|---|---|
| Thickness (mils) | 30.8 | 23.9 |
| Basis weight (gms/sq. ft.) | 8.4 | 5.6 |
| Loss on Ignition (LOI) (%) | 22.3 | 23.5 |
| Tensile (lbs/3 in. width) | | |
| Machine Direction | 123.5 | 69 |
| Cross Mach. Dir. | 77.2 | 78 |
| Flex Tensile* (lbs/3 in.) | | |
| MD | 98.1 (79.4% of MD tensile) | 57.4 (82.7%) |
| CMD | 78.7 (100% of CMD tensile) | 57 (73.4%) |
| MD Tear (gms) | 388 | 226 |
| CMD Tear (gms) | 659 | 227 |
| Air permeability (CFM) | 880 | 930 |

Example 7

A first slurry was made according to Example 1 except that ¾ inch K137 wet chopped stand fiber product was used in place of the M137 wet product. A second slurry was made using the same procedure as Example 3 except that 0.5 inch long H137 wet chopped strand fiber (10 micron avg. diameter) product was used in place of the ¾ inch long K137 wet product. Also, a lower basis weight was targeted for this mat. The first slurry was fed to a first manifold at a rate 4 times the rate that the second slurry was fed to a second manifold. The resultant wet web was treated to the same binder described in Example 1, but excess binder was removed to the extent to achieve an LOI of about 26 wt. percent. The resultant bindered mat was dried and heated to 380 degrees to cure the binder. The resultant multilayer mat had the following properties.

| | Example 6 | Example 7 |
|---|---|---|
| Thickness (mils) | 23.9 | 22.2 |
| Basis weight (gms/sq. ft.) | 5.6 | 5.5 |
| Loss on Ignition (LOI) (%) | 23.5 | 25.9 |
| Tensile (lbs/3 in. width) | | |
| Machine Direction | 69 | 105 |
| Cross Mach. Dir. | 78 | 82 |
| Flex Tensile* (lbs/3 in.) | | |
| MD | 57.4 (82.7% of MD tensile) | 99 (93.8%) |
| CMD | 57.4 (73.4% of CMD tensile) | 63 (76.2%) |
| MD Tear (gms) | 226 | 181 |
| CMD Tear (gms) | 227 | 290 |
| Air permeability (CFM) | 930 | 958 |

This mat had properties similar to or superior to mat containing all H diameter glass fibers, and also a mat containing a mixture of 80 percent K fibers and 20 percent H fibers. One surface of this mat was equivalent to a mat containing all H glass fibers and superior to the surfaces of the mat of Example 6. The cost of this mat was far less than a mat containing all H glass fibers and substantially less than the mat of Example 6.

Different embodiments employing the concept and teachings of the invention will be apparent and obvious to those of ordinary skill in this art and these embodiments are likewise intended to be within the scope of the claims. For example, a mat made according to the invention from a first slurry containing K117 glass fiber from Johns Manville Corporation and a second slurry containing 206 glass microfiber from Johns Manville and bound with the same binders used in the above Examples would be superior to the mats disclosed in U.S. Pat. No. 4,637,951 by being stronger, having greater integrity and lower in cost because less microfiber would be required. The inventor does not intend to abandon any disclosed inventions that are reasonably disclosed but do not appear to be literally claimed below, but rather intends those embodiments to be included in the broad claims either literally or as equivalents to the embodiments that are literally included.

What is claimed is:

1. A method of making a multilayer fibrous nonwoven mat comprising forming a first slurry containing fibers, forming a second slurry containing fibers and/or particles, feeding the first slurry to a manifold on a forming box, feeding the second slurry to a second manifold on the same forming box, feeding the two slurries inside the forming box to a moving forming wire, the two slurries separated from each other for a portion of the distance from a back wall of the forming box to the forming wire with a flexible lamella, the lamella ending a distance before reaching the forming wire sufficient to allow some mixing of the first slurry and the second slurry before the slurry mixture reaches the forming wire, forming a first layer on the moving forming wire from the first slurry, forming a transition zone on top of the first layer from a mixture of the two slurries, forming a second layer on top of the transition zone from the second slurry to form a wet multilayer web or mat, transferring the wet multilayer web to a second moving screen, and drying the multilayer mat to form a multilayer mat containing a transition zone having a thickness in the range of about 2 to about 10 percent of the thickness of the dry multilayer mat.

2. The method of claim 1 wherein at least one of the slurries contains glass fibers.

3. The method of claim 2 wherein one or the slurries contains glass fibers having an average diameter of about 13 microns and an average length of about ¾ inch and the other slurry contains glass fibers having an average diameter of about 16 microns and an average length of about 1.25 inches.

4. The method of claim 1 wherein the composition of at least two of the slurries is different.

5. The method of claim 1 wherein the thickness of the transition zone is in the range of about 2-10 percent of the thickness of the multilayer mat.

6. The method of claim 1 wherein one of the slurries contains 6 denier polyester fibers having an average length of about 1 inch and the other slurry contains glass fibers having an average diameter of about 16 microns and an average length of about 1.25 inches.

7. The method of claim 1 wherein one of the slurries contains about 50 wt. percent 6 denier polyester fibers having an average length of about 1 inch and about 50 wt. percent glass fibers having an average diameter of about 16 microns and an average length of about 1.25 inches and the other slurry contains glass fibers having an average diameter of about 16 microns and an average length of about 1.25 inches.

8. The method of claim 1 wherein one of the slurries contains glass fibers having an average diameter of about 13 microns and an average length of about ¾ inch and the other slurry contains glass fibers having an average diameter of about 10 microns and an average length of about ½ inch, the fiber mass of the layer made from the slurry containing the 13 micron glass fibers being about 4 times that of the second layer.

9. A method of making a multilayer fibrous nonwoven mat comprising forming a slurry containing fibers, feeding a first portion of the slurry to a first manifold on a forming box, feeding a second portion of the slurry to a second manifold on the same forming box, feeding the first portion of the slurry and the second portion of the slurry inside the forming box to a moving forming wire, the first and second portions of the slurry separated from each other for a portion of the distance beginning at a back wall of the forming box to the forming wire with a flexible lamella, the lamella ending a distance before reaching the forming wire, the distance being sufficient to allow mixing of the first portion with the second portion of the slurry, forming a first layer on the moving forming wire from the first portion of the slurry, forming a transition zone on top of the first layer from the mixture of the two portions of the slurry, forming a second layer on top of the transition zone from the second portion of the slurry to form a wet multilayer web or mat, transferring the wet multilayer web to a second moving screen, and drying the multilayer mat to form a multilayer mat containing a transition zone having a thickness of at least one percent of the thickness of the dry multilayer mat.

10. The method of claim 9 wherein the thickness of the transition zone is in the range of about 3-10 percent of the thickness of the multilayer mat.

11. The method of claim 9 wherein the transition zone has a thickness of at least 4 percent of the thickness of the multilayer mat.

12. The method of claim 9 wherein one or the slurries contains glass fibers having an average diameter of about 13 microns and an average length of about ¾ inch and the other slurry contains glass fibers having an average diameter of about 16 microns and an average length of about 1.25 inches.

13. A method of making a multilayer fibrous nonwoven mat comprising forming a first slurry containing fibers, forming a second slurry containing fibers and/or particles, feeding the first slurry to a first manifold on a forming box, feeding the second slurry to a second manifold on the same forming box, feeding the first slurry or a third slurry to a third manifold on the same forming box, feeding the slurries inside the forming box to a moving forming wire, the different slurries being separated from each other for a portion of the distance from a back wall of the forming box to the forming wire with a flexible lamella located in the forming box between the different slurries, the lamellae ending a distance before reaching the forming wire, the distance being sufficient to form some mixing of fibers from the first slurry and fibers and/or particles from the second slurry, and some mixing of the fibers and/or particles in the second slurry and fibers in the third slurry, forming a first layer on the moving forming wire from the first slurry, forming a first transition zone on top of the first layer from a mixture of the two adjacent slurries, forming a second layer on top of the first transition zone from the second slurry, forming a second transition zone on top of the second layer from a mixture of the second slurry and either the first slurry or the third slurry, forming a third layer on top of the second transition zone to form a wet multilayer web transferring the wet multilayer web to a second moving screen, and drying to form a multilayer mat containing two transition zones, the thickness of each transition zone being at least about 2 percent of the thickness of the dried multilayer fibrous mat.

14. The method of claim 13 wherein a binder is applied to the wet multilayer web prior to drying.

15. The method of claim 14 wherein at least one of the slurries contains glass fibers.

16. The method of claim 13 wherein the thickness of at least one of the transition zones has a thickness in the range of about 2-10 percent of the thickness of the multilayer fibrous mat.

17. The method of claim 16 wherein at least one of the slurries contains glass fibers.

18. The method of claim 14 wherein the thickness of at least one of the transition zones has a thickness in the range of about 3-10 percent of the thickness of the multilayer fibrous mat.

19. The method of claim 13 wherein at least one of the slurries contains glass fibers.

* * * * *